US005303726A

United States Patent [19]

Merrill

[11] Patent Number: 5,303,726

[45] Date of Patent: Apr. 19, 1994

[54] DEVICE TO HOLD A COVER

[76] Inventor: Timothy B. Merrill, 8433 SE. Murphy Ct., Clackamas, Oreg. 97015

[21] Appl. No.: 13,291

[22] Filed: Feb. 4, 1993

[51] Int. Cl.[5] ..... E04H 15/08

[52] U.S. Cl. ..... 135/89; 135/119; 403/314; 403/379

[58] Field of Search ..... 135/115, 119, 89; 403/378, 379, 314

[56] References Cited

U.S. PATENT DOCUMENTS

| | | | |
|---|---|---|---|
| 2,348,387 | 5/1944 | Hume | 135/115 X |
| 2,787,321 | 12/1955 | Dietz . | |
| 2,967,535 | 1/1961 | Freeman | 135/89 |
| 3,182,672 | 5/1965 | Biller, Jr. | 135/119 X |
| 3,720,438 | 3/1973 | Johnson et al. | 135/89 X |
| 3,851,848 | 12/1974 | Wiele . | |
| 4,175,576 | 11/1979 | Iby | 135/89 |

*Primary Examiner*—Carl D. Friedman

*Assistant Examiner*—Lan C. Mai

*Attorney, Agent, or Firm*—Eugene D. Farley

[57] ABSTRACT

This invention is a rod with a hook. Multiples rods are placed into an awning rail slot. This hooks on a cover with poles to provide shade. Hooks are positioned by sliding in the awning rail slot. Hooks align with grommets in the cover. Hooks are secured inside the awning rail slot by screwing the threaded shank of the hook through the rod and against the inner back side of the rail slot. The number of grommets are determined by the width of the cover. Grommets in the cover are attached onto the individual hooks along the awning rail. Poles are placed in grommets on the opposite side of cover. Poles are pulled away from the structure. They are held in place by ropes. The ropes overlap the cover at the top of the pole and are secured to stakes in the ground, and held taut by a rope slip. The poles used to support the cover may be adjusted to a desired height for providing shade.

4 Claims, 2 Drawing Sheets

DEVICE TO HOLD A COVER

FIELD OF INVENTION

This invention relates to a cover-holding device used in conjunction with fabric, poles and ropes. It is affordable and portable. The cover provides shade and cover from environmental elements such as sun and rain, and is usable on recreational vehicles such as fifth wheels, travel trailers and motor homes. Residential houses and commercial buildings are other options.

BACKGROUND OF INVENTION

Awnings are used for shade. They protect from the environmental elements, rain, ultraviolet light and wind. Most awnings are permanently attached to a vehicle and/or building. The other type of awning-/cover is removable, and it requires a ladder. Both these types are expensive, heavy and hard to handle.

The removable type of cover requires the installers to climb a ladder. The cover has a rope sewn into its edge and is guided through an awning rail slot the length of the vehicle. This requires moving a ladder every few feet to reach the rope.

SUMMARY OF THE INVENTION

The device of this invention includes an elongated tubular rod retainer removably retaining a plurality of rods therein, each rod mounting the threaded shank of a hook in a threaded transverse bore in the rod, the hook shank extending forwardly through an opening in the rod retainer and terminating in an open hook. The threaded shank extends into abutment with the inner back surface of the tubular rod retainer, whereby to press the rod into frictional engagement with the inner front surface of the tubular rod retainer and thereby secure the rod against longitudinal displacement in the tubular rod retainer. A lock nut on the threaded shank releasably engages the outer front surface of the tubular rod retainer to prevent loosening of the hook by rotation about the axis of the threaded shank. The tubular rod retainer and hook assembly is supported by a rail mounted on a mobile home or other rigid structure, with the hooks opening upwardly and the planes of the hooks being dispose perpendicular to the longitudinal axis of the rods.

The device in this invention will allow the people to install and remove a cover without a ladder. A pole is used to secure the cover onto the hooks with relative ease.

This invention is easily installed. It is relatively inexpensive. It is easy to handle and is lightweight.

The foregoing and other objects and advantages of this invention will appear from the following detailed description, taken in connection with the accompanying drawings of a preferred embodiment.

DESCRIPTION OF THE PREFERRED EMBODIMENT

Figure 2:
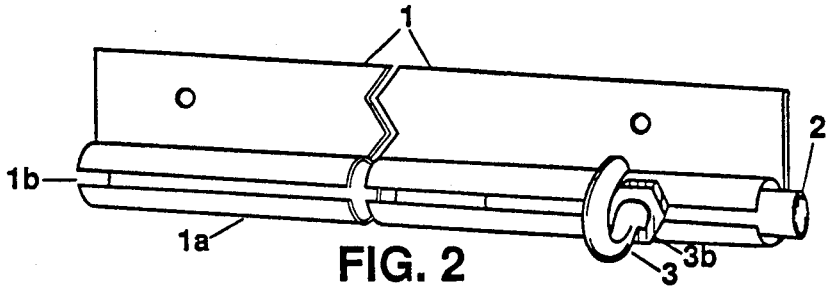
FIG. 2 is a foreshortened perspective view of the cover holding device of FIG. 1.

FIG. 2 shows a rod 2 that is machined to specifications that will allow it to be slidable within tubular rod retainer 1*a* formed integral with or otherwise secured to awning rail 1. The rod is bored and tapped to receive the threaded shank 3*a* of hook 3. The hook is open to specifications that allow it to hook onto a grommet. When hook 3 and its shank 3*a* is screwed clockwise, the end of the shank presses against the inner back side of the tubular rod retainer 1*a* on awning rail 1. This forces the rod against the front opening 1*b* in the rod retainer. A nut 3*b* is used to lock the hook in vertical position.

Figure 3:
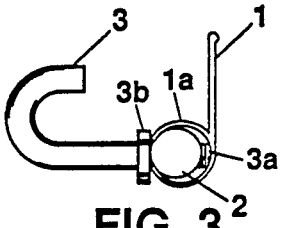
FIG. 3 is an end elevation as viewed from the right in FIG. 2.
Figure 4:
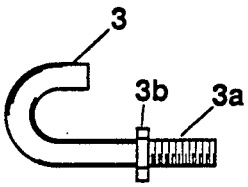
FIG. 4 is an end elevation similar to FIG. 3 showing only the hook and threaded shank and lock nut.
Figure 5:
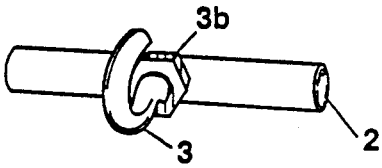
FIG. 5 is a perspective view of the rod and hook components of the assembly of FIG. 2.
Figure 7:
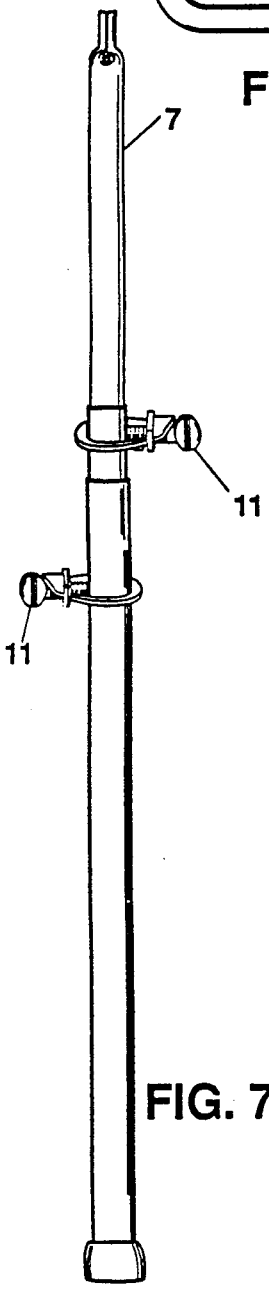
FIG. 7 is a perspective view of the awning support pole shown in FIG. 1.
Figure 6:
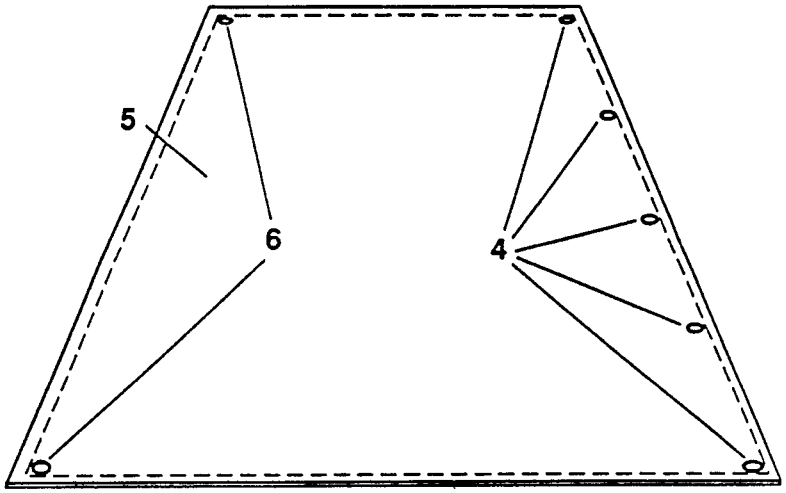
FIG. 6 is a perspective view of the fabric awning as shown in FIG. 1.

Slide the rod 2 and hook 3 into the tubular rod retainer 1*a* of awning rail 1, as in FIG. 2. The number of rods and hooks, will correspond with the number of grommets 4 on fabric 5, FIG. 3.

Align the first rod 2 and hook 3 in the rod retainer 1*a*. Turn hook 3 tight then finish by disposing the hook in a vertical plane and with its open end facing upwardly, as shown in FIG. 2. This will secure rod 2 from sliding in the tubular rod retainer 1*a*. Tighten the nut 3*b* down to the lock rod 2 and hook 3 into position. Hook grommet 4 on fabric 5 onto hook 3.

Move along awning rail 1 to next rod 2 and hook 3. Pull the fabric so hook 3 is aligned to the center of the grommet 4. Tighten hook 3 to finish in a vertical position. Tighten down nut 3*b*, then hook grommet 4 on fabric 5 on to hook 3. Proceed down the remainder of awning rail 1, following this procedure to the last grommet 4 on the fabric 5. These procedures are only required the first time. This permanently positions and locks rods 2 and hooks 3 into place.

Figure 1:
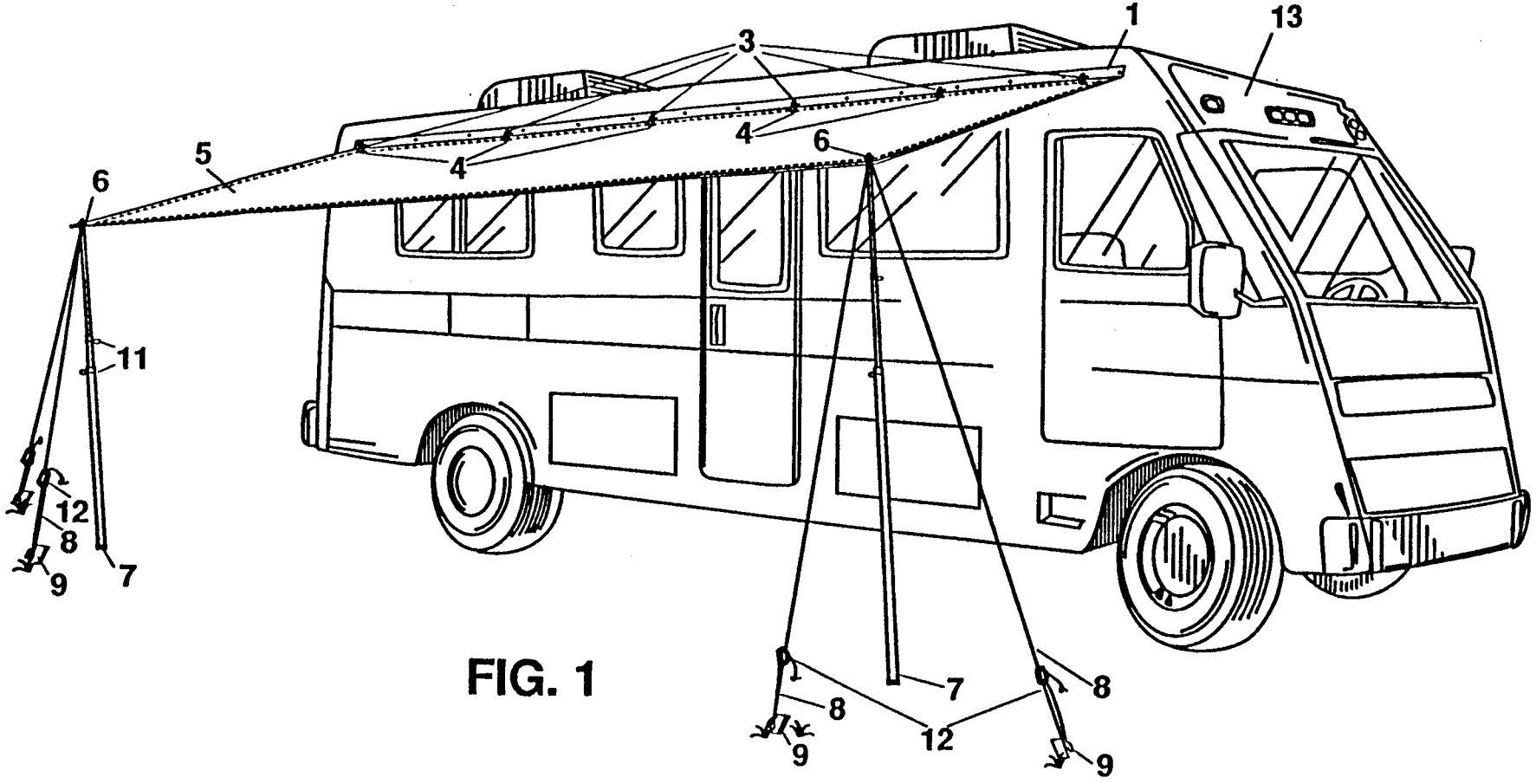
FIG. 1 is a perspective view of a motor home structure incorporating a portable awning supported by a holding device embodying the features of this invention.
Figure 8:
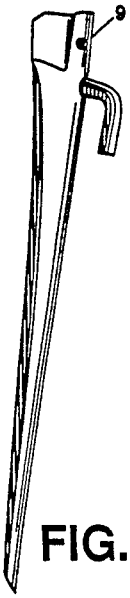
FIG. 8 is a perspective view of the anchor stake shown in FIG. 1.
Figure 9:
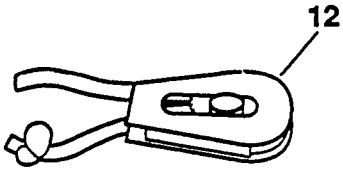
FIG. 9 is a perspective view of the cord lock shown in FIG. 1.

Next, adjust the height of poles 7 to approximately 6 feet by loosening and then tightening turn screw clamps 11. Pull fabric 5 up away from motor home 13. Place the tip of a pole 7 through grommet 6 in a corner of fabric 5 FIG. 3. Tie a loop in a rope 8 and place the loop on the tip of pole 7 projecting through the grommet. Pull directly from the motor home. Place a stake 9, FIG. 8, in the ground, as shown in FIG. 1 three feet from pole 7, as in FIG. 1. Hook rope 8 around the stake 9, FIG. 1, then pull taut. Secure with rope slip 12, FIG. 9. Tie a loop in a second rope 8, FIG. 1. Place the loop on the tip of the pole 7. Move to the side of the pole 90 degrees from the first stake. Repeat this procedure at the opposite end of fabric 5, as shown in FIG. 1. Ensure that all ropes are taut.

These procedures require a ladder, pliers and $\frac{3}{8}$ inch wrench for the first installation. A hammer is needed for installation of stakes.

To remove the awning, loosen all ropes. With an extra extended pole, push up next to the grommets 6 to detach the supporting poles 7. Unhook the fabric grommets 4 from the hooks 3 which remain in the rods 2 in the rod retainer 1*a* on the awning rail for the next use of the awning. Do not loosen or move the hooks.

To replace the awning, repeat the installation procedure outlined hereinbefore.

I claim:

1. A device for supporting flexible fabric from a rigid structure, wherein the fabric has a hook-receiving opening therein, the device comprising:

a) an elongated tubular rod retainer having a front side, an inner back side, an inner front side, a longitudinal bore and an opening extending inwardly from the front side of the retainer to said bore, b) a rod having a front side, said rod being supported slidably in the bore of said tubular rod retainer and having a threaded bore extending through said rod perpendicular to the longitudinal axis of said rod, c) a hook member having a threaded shank extending through said opening in the tubular rod retainer and through the threaded bore in said rod into abutment with the inner back side of the tubular rod retainer, for pressing the front side of the rod against the inner front side of the tubular rod retainer, and d) support means for interengaging the tubular rod retainer and a rigid structure, with the hook of the hook member positioned in a plane disposed substantially perpendicular to the longitudinal axis of the rod, for receiving a hook-receiving opening in a flexible fabric to be supported.

2. The device of claim 1 including lock means on the threaded shank of the hook member engageable with the tubular rod retainer for releasably securing the hook member against rotation about the axis of the shank.

3. The device of claim 1 wherein the opening in the tubular rod retainer is a slot extending the length of the rod retainer.

4. The device of claim 1 wherein the support means comprises an elongated rail, the tubular rod retainer extends the length of the rail, a plurality of rods are supported slidably in the longitudinal bore of the rod retainer, a hook member is associated with each rod, and an opening in the tubular rod retainer is a slot extending the length of the rod retainer.

* * * * *